US006547125B2

(12) United States Patent
Correll

(10) Patent No.: US 6,547,125 B2
(45) Date of Patent: Apr. 15, 2003

(54) MATERIAL-SAVING FOOD CARTON

(76) Inventor: John D. Correll, 8459 Holly Dr., Canton, MI (US) 48187-4237

( * ) Notice: Subject to any disclaimer, the term of this patent is extended or adjusted under 35 U.S.C. 154(b) by 78 days.

(21) Appl. No.: 09/950,112

(22) Filed: Sep. 10, 2001

(65) Prior Publication Data

US 2003/0047593 A1 Mar. 13, 2003

(51) Int. Cl.[7] ..... B65D 5/20

(52) U.S. Cl. ..... 229/110; 229/112; 229/147; 229/151; 229/152; 229/906

(58) Field of Search ..... 229/110, 112, 229/113, 114, 147, 151, 152, 153, 154, 902, 906, 915, 916

(56) References Cited

U.S. PATENT DOCUMENTS

| | | | | | |
|---|---|---|---|---|---|
| 917,347 | A | | 4/1909 | Neumann | |
| 1,141,076 | A | | 5/1915 | Shapiro | |
| 2,072,753 | A | | 3/1937 | Ikeda et al. | |
| 2,076,018 | A | * | 4/1937 | Ferguson | 229/113 |
| 3,063,617 | A | * | 11/1962 | Schabes | 229/154 |
| 3,253,769 | A | | 5/1966 | Opler | |
| 3,361,329 | A | | 1/1968 | Fox | |
| 4,339,068 | A | | 7/1982 | Brauner | |
| 4,765,534 | A | | 8/1988 | Zion et al. | 229/109 |
| 4,804,136 | A | | 2/1989 | Hall | 229/112 |
| 5,000,374 | A | | 3/1991 | Deiger | 229/109 |
| 5,125,566 | A | * | 6/1992 | Deiger | 229/110 |
| 5,199,636 | A | * | 4/1993 | Young | 229/151 |
| 5,305,951 | A | | 4/1994 | Kuhn et al. | 229/105 |
| 5,402,929 | A | * | 4/1995 | Ritter et al. | 229/906 |
| 5,452,845 | A | * | 9/1995 | Ritter | 229/906 |
| 5,603,450 | A | | 2/1997 | Whitnell | 229/148 |
| 5,669,552 | A | | 9/1997 | Watanabe | 229/114 |
| 5,702,054 | A | | 12/1997 | Philips et al. | 229/110 |
| 5,921,466 | A | * | 7/1999 | Speese et al. | 229/902 |
| 6,065,669 | A | * | 5/2000 | Correll | 229/112 |
| 6,092,715 | A | * | 7/2000 | Correll | 229/110 |
| 6,223,979 | B1 | * | 5/2001 | Correll | 229/114 |

* cited by examiner

*Primary Examiner*—Gary E. Elkins

(57) ABSTRACT

A non-fastened food carton embodying one or more of the following structural features: (1) a slanting-wall-enabling cover side flap structure, (2) a bottom panel that has a front-to-rear length that's longer than a left-to-right width of the bottom panel and a full-length cover panel that has a front-to-rear length that's shorter than the bottom panel's front-to-rear length, (3) a bottom panel having a front-to-rear length that's at least six millimeters longer than the diameter of a pizza contained within the carton and a full-length cover panel having a front-to-rear length that's at least eight millimeters shorter than the diameter of the pizza, (4) a stack of inward-slanting-wall pizza cartons that have no stacking-impeding tabs projecting beyond the cover panel, (5) a non-rectangular carton structure involving a cover front flap that has a height that's substantially shorter than the height of the front wall, and (6) a rigidizing rear wall in which the rear wall has a left-to-right width at least six millimeters longer than the left-to-right width of the cover panel.

33 Claims, 3 Drawing Sheets

FIG-2
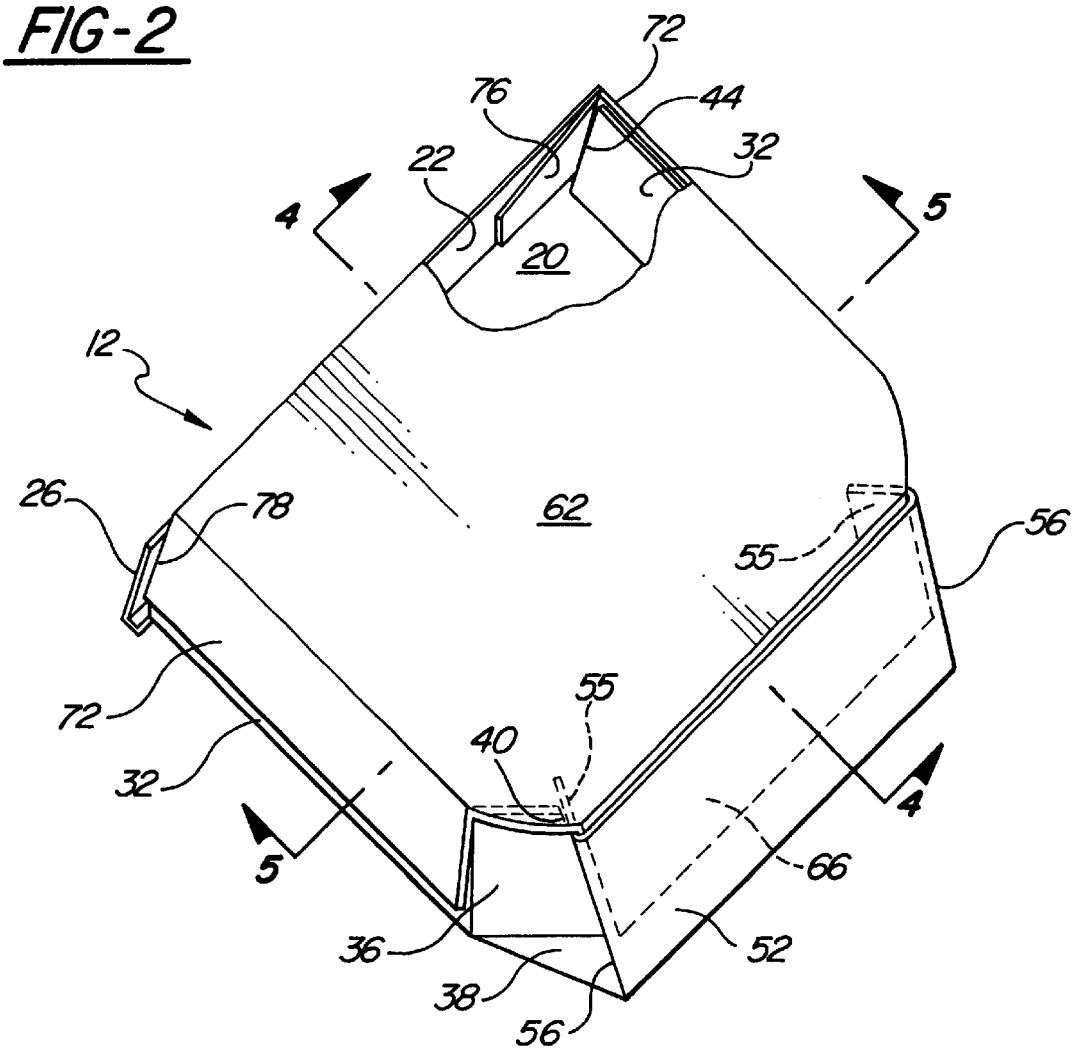
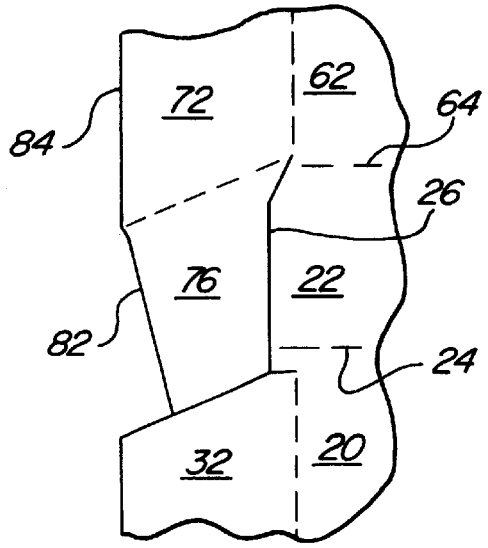
FIG-3

FIG-4
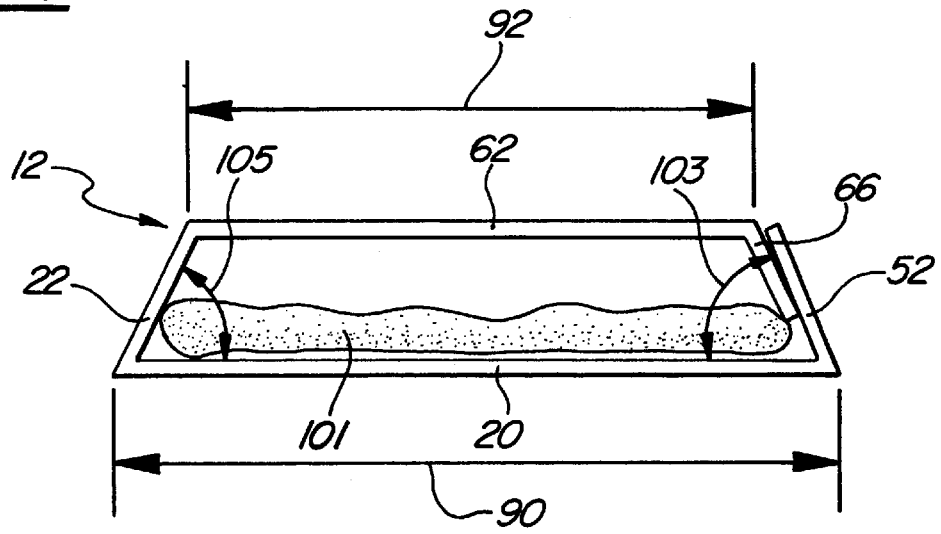
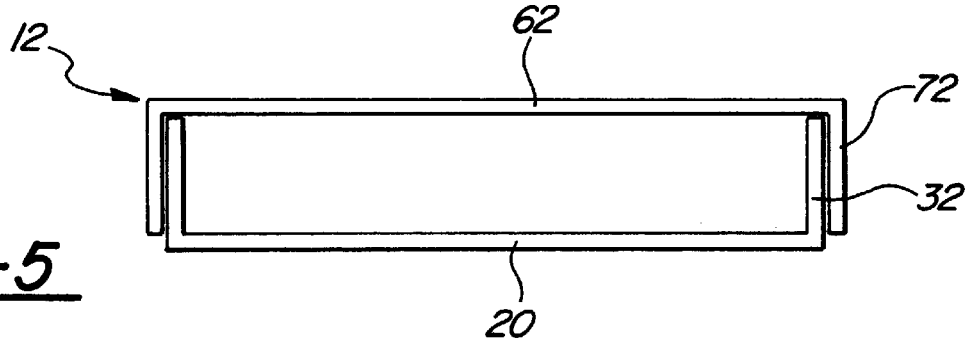
FIG-5
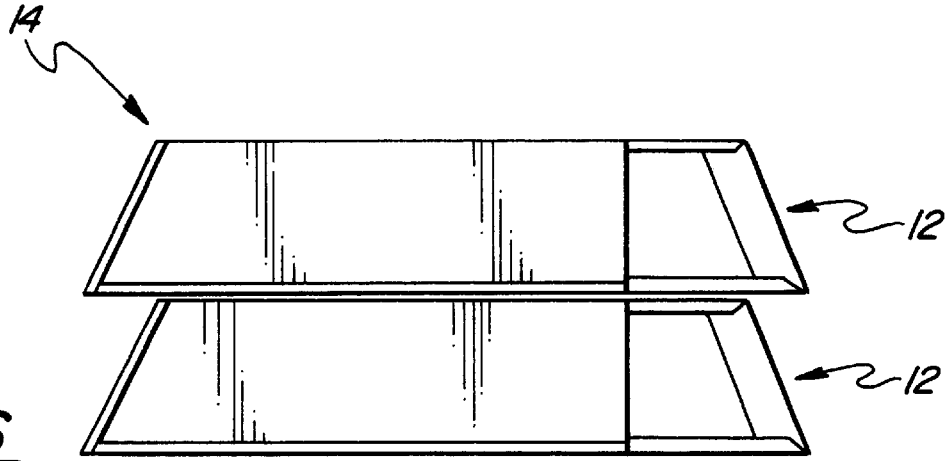
FIG-6

MATERIAL-SAVING FOOD CARTON

FIELD OF THE INVENTION

This invention relates to cartons made of foldable material and, in particular, to paperboard cartons for food products such as pizza.

DESCRIPTION OF THE PRIOR ART

Each year thousands of pizza businesses sell millions of hot pizzas for delivery and carry-out. The success of these businesses depends to an extent on the cost and functionality of the cartons used for packaging the product. Ideally, these cartons should be cost-effective, easy to use, stackable, and rigid and crush-resistant.

Prior art structure can be defined in terms of slanting-wall versus non-slanting-wall construction. A carton of slanting-wall construction has at least one wall disposed at a substantially oblique angle (i.e., either obtuse angle or acute angle) to the bottom panel. A carton of non-slanting-wall construction has all the walls disposed substantially perpendicular to the bottom panel. A carton having slanting-wall construction is sometimes called a "slanting-wall carton." A carton having non-slanting-wall construction is sometimes called a "non-slanting-wall carton."

Slanting-wall cartons further can be divided into "all-slanting-wall cartons" and "some-slanting-wall cartons." In an all-slanting-wall carton all the walls are slanting. In a some-slanting-wall carton at least one of the walls is slanting and at least one of the walls is substantially perpendicular to the bottom panel.

Slanting-walls also can be divided into two types: outward-slanting walls, which are disposed at an obtuse angle to the bottom panel, and inward-slanting walls, which are disposed at an acute angle to the bottom panel.

A possible advantage of an inward-slanting-wall carton is material-savings. A possible advantage of a non-slanting-wall carton is maximal stacking strength. Finally, a possible advantage of a some-slanting-wall carton having an inward-slanting wall and a perpendicular wall is a combination of both material-savings and stacking strength (which can be an important feature to a pizza delivery business).

Prior art structure also can be defined in terms of fastened versus non-fastened construction. A carton of fastened construction has at least one corner panel or corner flap permanently fastened to an adjacent panel or flap by means of glue, staple, or stitches. Conversely, a carton of non-fastened construction has no corner panels or corner flaps fastened to an adjacent panel or flap by means of glue, staple, or stitches. A carton having fastened construction is sometimes called a "fastened carton." Similarly, a carton having non-fastened construction is sometimes called a "non-fastened carton." A possible advantage of a fastened carton is quick set-up. A possible advantage of a non-fastened carton is low-cost manufacture and price savings (a feature that's highly important to most pizza businesses).

In addition, prior art structure can be defined in terms of full-length cover panel versus partial-length cover panel construction. A carton having full-length cover panel construction has a cover panel that extends from one wall substantially all the wall to an opposing wall or wall structure of the carton, whereby the cover panel overlies the entire cavity, or virtually the entire cavity, of the carton. A carton having partial-length cover panel construction has no full-length cover panel but, instead, most likely has one or more cover panels that each overlie only a portion of the cavity of the carton. A possible advantage of full-length cover panel construction is structural rigidity, or resistance to downward pressure, in the center of the cover panel (a feature that is very important to pizza delivery operations, where heavy objects like a liter bottle of soda are often carried on top of the pizza box).

Further, prior art can be defined in terms of stackable versus non-stackable construction. A carton of stackable construction has no stacking-impeding tabs projecting above the cover panel of the box (a stacking-impeding tab being one that would prevent the bottom panel of an upper box from fully contacting the cover panel of a lower box when the two boxes are in a stacked arrangement). A carton of non-stackable construction has one or more stacking-impeding tabs projecting above the top surface of the cover panel.

Finally, prior art structure can be defined in terms of rectangular versus non-rectangular cartons. A "rectangular carton" is one which has a substantially rectangular bottom panel and four wall panels. A "non-rectangular carton" is one which has a non-rectangular bottom panel and five or more wall panels. A possible advantage of some non-rectangular cartons is material savings.

The instant invention pertains to non-fastened cartons. The preferred embodiment of the invention also pertains to a particular structure of non-rectangular, some-slanting-wall carton of stackable construction having a full-length cover panel.

The prior art discloses the following cartons having at least one inward-slanting wall: Neumann U.S. Pat. No. 917,347 granted Apr. 6, 1909; Shapiro U.S. Pat. No. 1,141,076 granted May 25, 1915; Ikeda et al. U.S. Pat. No. 2,072,753 granted Mar. 2, 1937; Opler U.S. Pat. No. 3,253,769 granted May 31, 1966; Fox U.S. Pat. No. 3,361,329 granted Jan. 2, 1968; Brauner U.S. Pat. No. 4,339,068 granted Jul. 13, 1982; Hall U.S. Pat. No. 4,804,136 granted Feb. 14, 1989; Kuhn et al. U.S. Pat. No. 5,305,951 granted Apr. 26, 1994; Whitnell U.S. Pat. No. 5,603,450 granted Feb. 18, 1997; and Watanabe U.S. Pat. No. 5,669,552 granted Sep. 23, 1997. In addition, the prior art discloses Zion et al. U.S. Pat. No. 4,765,534 granted Aug. 23, 1988, which shows a carton having a curved wall that is inward-slanting at the ends but non-slanting (or substantially perpendicular) at the center. This curved wall provides no material savings over a non-slanting wall and this Zion et al. carton does not qualify as a slanting-wall carton.

In addition to the Zion et al. patent, which shows a non-rectangular carton, the prior art also discloses the following additional two non-rectangular cartons: Deiger U.S. Pat. No. 5,000,374 granted Mar. 19, 1991, and Philips et al. U.S. Pat. No. 5,702,054 granted Dec. 30, 1997. The Philips et al. carton is currently being used by Domino's Pizza as its pizza carton. A problem with all of these non-rectangular cartons is a tendency to collapse when the cover panel is pushed in a rearward direction relative to the bottom panel. This rearward pushing action on the cover panel can sometimes inadvertently occur during delivery, particularly when multiple cartons are stacked. In the Philips et al. carton the rearward pushing action on the cover panel results in the rear ends of the left and right cover side flaps sliding past the ends of the rear wall, resulting in a total collapse of the carton. It would be desirable to have a structure that prevents this from happening.

All of the above-cited prior art have one or more drawbacks as applied to delivery/carry-out pizza operations.

Specifically, Shapiro, Fox, Brauner, Whitnell, and Watanabe are fastened cartons. Neumann, Ikeda et al., Opler, Brauner, Kuhn et al., Whitnell, and Watanabe are all-slanting-wall cartons (i.e., having no non-slanting walls). Fox, Hall, and Kuhn et al. have only partial-length cover panels. Hall and Whitnell are not stackable (i.e., they have one or more stacking-impeding tabs). And Zion et al., Deiger, and Philips et al. have no material-saving inward-slanting walls at all. Plus Zion et al., Deiger, and Philips et al. are prone to collapse when a rearward pushing action is applied to the cover panel.

So, there has remained a need for a pizza carton that (a) achieves a material savings (derived from inclusion of one or more inward-slanting walls and/or a partial-height cover front flap), (b) has low manufacturing cost (derived from non-fastened construction), (c) has maximal stacking strength (derived from inclusion of one or more non-slanting walls), (d) has a collapse-proof cover (derived from inclusion of a full-length cover panel), and (e) has stackability (derived from avoidance of stacking-impeding tabs).

In conclusion, it would be highly desirable to provide a pizza carton that overcomes the above-cited drawbacks and satisfies the above-described need. Nothing in the prior art does that. However, my invention does.

SUMMARY OF THE INVENTION

My invention is a non-fastened food carton that can incorporate one or more of the following features:

1) A slanting-wall-enabling cover side flap structure comprising a cover side flap hingedly attached to a cover panel at a cover side flap fold line and a corner flap hingedly attached to an end of the cover side flap at a fold line disposed at an oblique angle to the cover side flap fold line, and with the corner flap disposed between an end wall and an end of a side wall of the carton;
2) A bottom panel that has a front-to-rear length that's longer than a left-to-right width of the bottom panel and a full-length cover panel that has a front-to-rear length that's shorter than the bottom panel's front-to-rear length, with the carton including both inward-slanting and non-inward-slanting walls;
3) In relation to a pizza contained within the carton, a bottom panel having a front-to-rear length that's at least six millimeters longer than the diameter of the pizza and a full-length cover panel having a front-to-rear length that's at least eight millimeters shorter than the diameter of the pizza, with the carton also including both inward-slanting and non-inward-slanting walls;
4) A stack of inward-slanting-wall pizza cartons that have no stacking-impeding tabs projecting beyond the cover panel;
5) A non-rectangular structure similar to that disclosed in Philips et al. U.S. Pat. No. 5,702,054 but with a cover front flap that has a height that's substantially shorter than the height of the front wall; and
6) A rigidizing rear wall in combination with left and right cover side flaps disposed exterior to left and right side walls, in which the rear wall has a left-to-right width at least six millimeters longer than the left-to-right width of the cover panel.

My invention typically would be used for packaging relatively flat food products such as pizza; however, it could take other forms for other food packaging purposes, as well.

A complete understanding of the invention can be obtained from the detailed description that follows.

OBJECT AND ADVANTAGE

The object of my invention is a material-saving food carton that sacrifices nothing in way of functionality and strength.

The advantage of my invention is cost savings for the box manufacturer and/or pizzeria owner without any attendant operational inconvenience or deterioration of package integrity.

Further objects and advantages of the invention will become apparent from consideration of the following detailed description, related drawings, and appended claims.

BRIEF DESCRIPTION OF THE DRAWINGS

FIG. 2 is a perspective view of a carton formed from the blank.

FIG. 3 is a plan view of a section of the blank.

FIG. 4 is a side sectional view of the carton taken along line 4—4 of FIG. 2 (with the carton holding a pizza).

FIG. 5 is a front sectional view of the carton taken along line 5—5 of FIG. 2.

FIG. 6 is a left side elevation view of two cartons in stacked arrangement.

LIST OF REFERENCE NUMERALS

Figure 1:
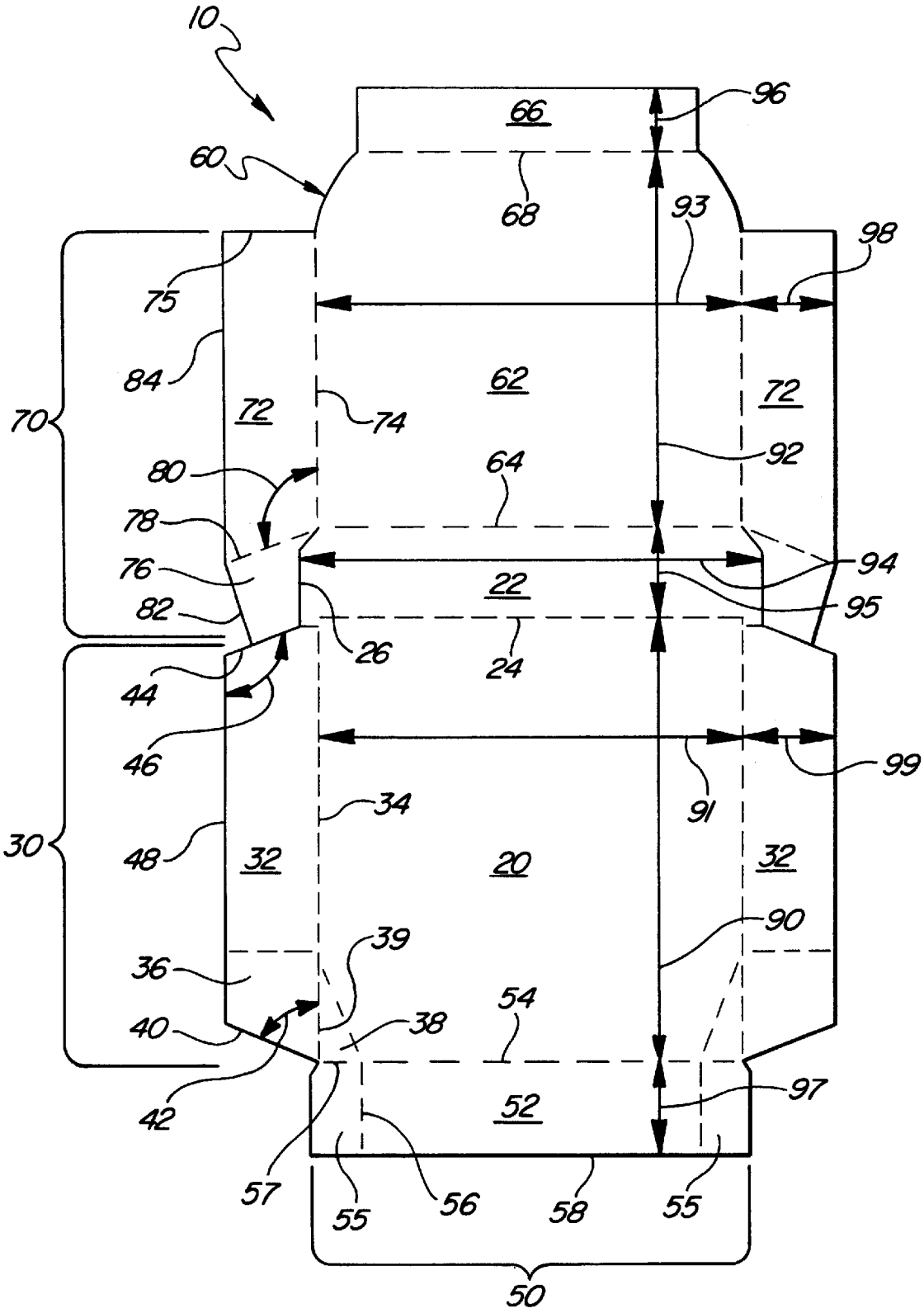
FIG. 1 is a plan view of a blank of the preferred embodiment.

Between drawings, like reference numerals designate corresponding parts.

10 blank of the preferred embodiment
12 carton of the preferred embodiment
14 stack of cartons
20 bottom panel
22 rear end wall
24 rear wall fold line
26 end of rear end wall
30 side wall structure
32 side wall
34 side wall fold line
36 front corner panel
38 connector panel
39 fold line (bottom edge of corner panel)
40 front end of corner panel
42 acute angle
44 rear end of side wall
46 obtuse angle
48 top edge of side wall
50 front wall structure
52 front end wall
54 front wall fold line
55 end panel
56 fold line
57 fold line
58 top edge of front end wall
60 cover
62 cover panel
64 cover panel fold line
66 cover front flap
68 cover front flap fold line
70 cover side flap structure
72 cover side flap
74 cover side flap fold line
75 front end of cover side flap
76 corner flap
78 corner flap fold line

80 oblique angle (obtuse angle)
82 lower edge of corner flap
84 lower edge of cover side flap
90 front-to-rear length of bottom panel
91 left-to-right width of bottom panel
92 front-to-rear length of cover panel
93 left-to-right width of cover panel
94 left-to-right width of rear end wall
95 height of rear end wall
96 height of cover front flap
97 height of front end wall
98 height of cover side flap
99 height of side wall
101 pizza
103 acute angle
105 acute angle

DESCRIPTION OF THE PREFERRED EMBODIMENT

The preferred embodiment is created from corrugated paperboard; however, other foldable materials can be used, as well. The intended use for the embodiment is as a pizza carton. However, it will be appreciated, as the description proceeds, that my invention may be realized in different embodiments and used in differing food packaging applications.

FIG. 1 shows a blank 10 and FIG. 2 shows a fully-erected pizza carton 12 created from blank 10. Carton 12 is a non-fastened carton, meaning it has no corner panels or corner flaps fastened to an adjacent panel or flap by means of glue, staple, or stitches. Referenced components are labeled in FIG. 1; selected components are labeled in other Figures. Corresponding parts between drawings share a same reference numeral. It is noted that the invention is bilaterally symmetrical (i.e., having identical left and right sides). Therefore, pairs of opposing like components are to be found, with one item of the pair on each side of the blank or carton. For simplicity of labeling, each component of the opposing pair will have the same reference numeral. Also, a pair may be indicated by a numeral on one side of the drawing only. Where this occurs, it is to be understood that the discussion also applies to the corresponding component on the other side, even though that component may not be numerically labeled.

Structure of the Embodiment

Referring in particular to FIG. 1 which shows blank 10, there is a bottom panel 20, a rear end wall 22 hingedly attached to bottom panel 20 at a rear wall fold line 24, and opposing left and right side wall structures 30. Rear end wall 22 has left and right ends 26. Each side wall structure 30 comprises a side wall 32 hingedly attached to bottom panel 20 at a side wall fold line 34 and disposed substantially perpendicular to rear end wall 22, a front corner panel 36 hingedly attached to a front end of side wall 32 at a fold line, a connector panel 38 hingedly attached to a bottom edge 39 of corner panel 36 at a fold line (also depicted by numeral 39). Front corner panel 36 has a front end 40 that is disposed at an acute angle 42 to bottom edge 39 (in the preferred embodiment angle 42 is approximately 68 degrees). Side wall 32 has a rear end 44 that is disposed at an obtuse angle 46 to a top edge 48 of the side wall (in the preferred embodiment angle 46 is approximately 112 degrees).

A front wall structure 50 comprises a front end wall 52 hingedly attached to bottom panel 20 at a front wall fold line 54 and left and right end panels 55 hingedly attached to respective left and right ends of front end wall 52 at a fold line 56 and to connector panel 38 at a fold line 57. Front end wall 52 has a top edge 58 that is free of attachment.

A cover 60 comprises a full-length cover panel 62 hingedly attached to rear end wall 22 at a cover panel fold line 64, a cover front flap 66 hingedly attached to a front edge of cover panel 62 at a cover front flap fold line 68, and left and right cover side flap structures 70. Each cover side flap structure 70 comprises a cover side flap 72 hingedly attached to a side edge of cover panel 62 at a cover side flap fold line 74 that's disposed perpendicular to rear end wall 22. The cover side flap has a front end 75 that is free of attachment. The side flap structure further comprises a corner flap 76 hingedly attached to a rear end of cover side flap 72 at a corner flap fold line 78. Corner flap fold line 78 is disposed at an oblique angle 80 to cover side flap fold line 74 (specifically, in the preferred embodiment angle 80 is an obtuse angle of approximately 112 degrees). As a general rule, this angle should be greater than 95 degrees and less than 115 degrees, although other degrees are possible. Corner flap 76 has a lower edge 82 that is non-aligned with a lower edge 84 of cover side flap 72. In blank 10, lower edge 82 slopes inward from lower edge 84. The angle of the slope is whatever is needed to retain cover side flap 72 in a proper (vertical) position after blank 10 has been folded into carton 12.

Key to the invention are certain dimensions. Specifically, bottom panel 20 has a front-to-rear length 90 and a left-to-right width 91. Cover panel 62 has a front-to-rear length 92 and a left-to-right width 93. Rear end wall 22 has a left-to-right width 94 and a height 95. Cover front flap 66 has a height 96. Front end wall 52 has a height 97. Cover side flap 72 has a height 98. And side wall 32 has a height 99.

In a five centimeter (two-inch) high pizza carton in the format of the preferred embodiment, front-to-rear length 90 will be longer than left-to-right width 91 by approximately ten millimeters (three-eighths inch). Front-to-rear length 92 will be substantially shorter than front-to-rear length 90 by approximately thirty eight millimeters (one-and-a-half inch). Cover front flap height 96 will be shorter than front wall height 97 by approximately twelve millimeters (one-half inch). Cover side flap height 98 will be approximately equal to side wall height 99.

Once blank 10 is set up into carton 12 a number of special structural arrangements occur. As illustrated in FIG. 4 which shows a side sectional view of carton 12 containing a recently-cooked round pizza 101 (this is the view taken along line 4—4 of FIG. 2), front and rear end walls 52/22 slant inward at substantially acute angles 103/105 to bottom panel 20. So the purpose in having bottom panel length 90 slightly longer than bottom panel width 91 is to create adequate space front-to-rear within the box cavity for accommodating a pizza having a diameter equivalent to width 91. As also seen in FIG. 4, the bottom panel's front-to-rear length 90 is slightly longer than the pizza's diameter (by at least six millimeters) and the cover panel's front-to-rear length 92 is substantially shorter than the pizza's diameter (by at least eight millimeters) This arrangement effects a material savings over a similarly-constructed carton having all non-slanting walls (i.e., the carton shown in Philips et al. U.S. Pat. No. 5,702,054).

As can be seen in FIG. 5, which shows a front sectional view of carton 12 taken along line 5—5 of FIG. 2, side walls 32 are disposed at a non-acute angle to bottom panel 20 (specifically, in the preferred embodiment the non-acute angle is a 90 degree angle).

As can be seen in FIG. 2, end panels 55 extend diagonally inward from front end wall 52 and contain cover front flap 66 between them. Corner panels 36 extend diagonally forward from side walls 32 and front end 40 of those panels abuts end panels 55. Connector panels 38 overlie bottom panel 20. Cover side flaps 72 are disposed exterior to side walls 32 (hence they're sometimes called exterior cover side flaps) and corner flaps 76 are perpendicular to the cover side flaps and disposed between rear end 44 and rear end wall 22.

Similarly-constructed cartons to the preferred embodiment (e.g., Philips et al. '054 carton) are prone to collapsing when a rearward-pushing force is applied to the cover panel relative to the bottom panel. This occurs because the rear ends of the cover side flaps slide past the ends of the rear end wall. To overcome this problem with my invention, left-to-right width 94 of rear wall 22 is made at least six millimeters longer than left-to-right width 93 of cover panel 62, thereby extending end 26 of rear end wall 22 well outside of end 78 of cover side flap 72. An enlarged diagram of this section of blank 10 is provided in FIG. 3 for the purpose of clearly depicting a suggested configuration for the preferred embodiment.

Also, in the Philips et al. '054 carton the height of the cover front flap is the same length as the height of the front end wall. However, in my invention, height 96 of cover front flap 66 is substantially shorter than height 97 of front end wall 52, thereby effecting a significant material savings.

Contrary to the inward-slanting-wall pizza carton disclosed in Hall U.S. Pat. No. 4,804,136, my invention is free of stacking-impeding tabs projecting above the cover panel of the carton. This enables multiple units to be stacked in the arrangement shown in FIG. 6, which illustrates a left side elevation view of a stack 14 containing two units of carton 12. In the drawing a slight gap is provided between the bottom panel of the upper box and the cover panel of the lower box. This gap is provided for clarity of illustration. In reality no such gap would exist and, instead, the bottom panel of the upper carton would sit on the cover panel of the lower carton or, more precisely, would contact two or more perimeter edges of the cover panel of the lower carton. Such an arrangement cannot be achieved with the Hall '136 carton due to the upward-projecting tabs extending from the top of the side walls.

Within the drawing of blank 10, a fold line between component parts of the invention is depicted with a dashed line. Within the context of this invention, a fold line can be created by a number of means such as, for example, by a crease or score in the board, by a series of aligned spaced short slits in the board, by a combination of aligned spaced short and long slits, or by a combination of a slit and a score. In conclusion, as referred to herein, a fold line is any line between two points on the blank or box along which the board is intended to be folded when the blank is being erected into a box or when the box is being manipulated as described herein. The type of fold lines shown in the drawings indicate one option. It will be appreciated that other types of fold lines known to those skilled in the art and depicted in prior art may be used.

Method for Erecting the Blank into the Carton

Any method used for erecting the blank of Philips et al. '054 patent can be used for erecting the preferred embodiment. In addition, the following method can be used, which is highly efficient.

First, position the blank so that it's horizontal and with the inside surface up and cover front flap 66 next to the abdomen.

Second, with your hands placed near the rear end of cover side flaps 72, simultaneously fold cover side flaps 72 inward and, with your index fingers, fold rear corner flaps 76 inward.

Third, while keeping your hands in that position (i.e., at the rear end of cover side flaps 72) and while holding the cover side flaps upright, with your fingers pull rear end wall 22 upright.

Fourth, fold bottom panel 20 downward to about halfway closed.

Fifth, fold side walls 32 inward and position them interior to cover side flaps 72 and then fold bottom panel 20 down until the carton is all the way, or almost all the way, closed.

Sixth, turn the partially-erected carton to a vertical position with front wall structure 50 up.

Seventh, open cover panel 62 about three inches and then, with your index fingers, push both front corner panels 36 inward. This will cause front wall structure 50 to assume an upright position.

Eighth, fold cover front flap 66 down and tuck it between end panels 55 and close the box completely. This step can sometimes be most easily executed with the rear end of the box held against a surface. This can be accomplished by either (a) holding the box vertically with the rear end resting on a table or (b) holding the box horizontally with the rear end held against your abdomen.

Definition of Key Terms

Certain terms are used in the claims for describing the invention. To insure clarity of meaning those terms are now specifically defined as used herein.

A "fastened carton" is a carton in which at least one corner panel or corner flap is permanently fastened to an adjacent panel or flap by means of glue, staple, or stitches.

A "non-fastened carton" is a carton that has no corner panels or flaps fastened to an adjacent panel or flap by means of glue, staple, or stitches.

A "front-to-rear length of a cover panel" is the distance between the cover panel fold line (connecting the cover panel to the rear wall) and the cover front flap fold line (connecting the cover front flap to the cover panel). The line of measurement is perpendicular to the cover panel fold line and is measured at the furthest distance between the two fold lines.

A "left-to-right width of a cover panel" is the distance between the left and right cover side flap fold lines (connecting the left and right cover side flaps to the cover panel), as measured parallel to the cover panel fold line. If it turns out that the left and right cover side flap fold lines are non-parallel, the measurement is taken along the rear edge of the cover panel (i.e., at the cover panel fold line).

A "front-to-rear length of a bottom panel" is the distance between the rear wall fold line (connecting the rear end wall to the bottom panel) and the front wall fold line (connecting the front end wall to the bottom panel). The line of measurement is perpendicular to the rear wall fold line and is measured at the furthest distance between the two fold lines.

A "left-to-right width of a bottom panel" is the distance between the left and right side wall fold lines (connecting the left and right side walls to the bottom panel), as measured parallel to the rear wall fold line.

A "substantially acute angle" is considered herein to be an angle of 85 degrees or less.

A "substantially non-acute angle" is considered herein to be an angle greater than 85 degrees.

A "full-length cover panel" is a cover panel that's hingedly attached to a wall of the carton and extends from that wall substantially all the way to an opposing wall structure.

An "inward-slanting wall" is a wall disposed at an acute angle to a bottom panel.

A "perimeter edge of a cover panel" is one of the front, rear, left, or right side edges of a cover panel.

CONCLUSION, RAMIFICATIONS, AND SCOPE

I have disclosed a non-fastened pizza carton embodying one or more of the following structural features:

1) A slanting-wall-enabling cover side flap structure comprising a cover side flap hingedly attached to a cover panel at a cover side flap fold line and a corner flap hingedly attached to an end of the cover side flap at a fold line disposed at an oblique angle to the cover side flap fold line, and with the corner flap disposed between an end wall and an end of a side wall of the carton;

2) A bottom panel that has a front-to-rear length that's longer than a left-to-right width of the bottom panel and a full-length cover panel that has a front-to-rear length that's shorter than the bottom panel's front-to-rear length, with the carton including both inward-slanting and non-inward-slanting walls;

3) In relation to a pizza contained within the carton, a bottom panel having a front-to-rear length that's at least six millimeters longer than the diameter of the pizza and a full-length cover panel having a front-to-rear length that's at least eight millimeters shorter than the diameter of the pizza, with the carton also including both inward-slanting and non-inward-slanting walls;

4) A stack of inward-slanting-wall pizza cartons that have no stacking-impeding tabs projecting beyond the cover panel;

5) A non-rectangular structure similar to that disclosed in Philips et al. U.S. Pat. No. 5,702,054 but with a cover front flap that has a height that's substantially shorter than the height of the front wall; and 6) A rigidizing rear wall in combination with left and right cover side flaps disposed exterior to left and right side walls, in which the rear wall has a left-to-right width at least six millimeters longer than the left-to-right width of the cover panel.

The illustrated number, size, shape, type, and placement of components represent the preferred embodiment; however, many other combinations and configurations are possible within the scope of the invention. For example, Philips et al. '054 discloses a particular cover locking structure involving tabs on the ends of the cover front flap that engage with slits in the fold lines connecting the end panels to the front end wall. This cover locking structure can easily be applied to the preferred embodiment.

The foregoing discussion has pertained mainly to packaging relatively flat food products such as pizza. However, it should be realized that my invention could be used for other food packaging purposes, as well. In conclusion, it is understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

I claim:

1. A non-fastened food carton having a slanting-wall-enabling cover side flap structure, said carton being of foldable material and comprising:

a bottom panel having a predetermined front-to-rear length and a predetermined left-to-right width, a rear end wall having a predetermined left-to-right width, left and right side wall structures comprising respective left and right side walls, a front wall structure comprising a front end wall having a predetermined height, and a cover comprising (a) a cover panel hingedly attached to said rear end wall and having a predetermined front-to-rear length and a predetermined left-to-right width and (b) left and right cover side flap structures comprising (i) respective left and right cover side flaps hingedly attached to said cover panel at respective left and right cover side flap fold lines and (ii) respective left and right corner flaps hingedly attached to an end of said left and right cover side flaps at respective left and right corner flap fold lines and disposed approximately perpendicular to said left and right cover side flaps;

wherein said left and right corner flap fold lines are disposed at a predetermined oblique angle to said left and right cover side flap fold lines, respectively, and said left and right corner flaps are disposed between one of said front and rear end walls and an end of said left and right side walls, respectively.

2. The carton of claim 1 wherein:

each said predetermined oblique angle is an obtuse angle.

3. The carton of claim 2 wherein:

said obtuse angle is greater than 95 degrees and less than 115 degrees.

4. The carton of claim 2 wherein:

said left and right cover side flaps are disposed exterior to said left and right side walls, respectively, and said left and right corner flaps are disposed between said rear end wall and an end of said left and right sides walls, respectively.

5. The carton of claim 4 wherein:

said rear end wall and said front end wall are each disposed at a substantially acute angle to said bottom panel and said left and right side walls are each disposed at a substantially non-acute angle to said bottom panel.

6. The carton of claim 5 wherein:

the predetermined front-to-rear length of said bottom panel is longer than the predetermined left-to-right width of said bottom panel and the predetermined front-to-rear length of said cover panel is substantially shorter than the predetermined front-to-rear length of said bottom panel.

7. The carton of claim 5 wherein:

the predetermined left-to-right width of said rear end wall is at least six millimeters longer than the predetermined left-to-right width of said cover panel.

8. The carton of claim 5 wherein:

said left and right side wall structures further comprise respective left and right front corner panels hingedly attached to a front end of said left and right side walls.

9. The carton of claim 8 wherein:

said left and right side wall structures further comprise respective left and right connector panels hingedly attached to a bottom edge of said left and right front corner panels and overlying said bottom panel.

10. The carton of claim 9 wherein:

said front wall structure further comprises left and right end panels hingedly attached to left and right ends of said front end wall and to said left and right connector panels, respectively.

11. The carton of claim 10 wherein:

said cover further comprises a cover front flap hingedly attached to a front edge of said cover panel and disposed between said left and right end panels and having a predetermined height substantially less than the predetermined height of said front end wall.

12. A non-fastened pizza carton having a full-length cover panel and material-saving dimensions, said carton being of foldable material and comprising:

a bottom panel having a predetermined front-to-rear length and a predetermined left-to-right width, a rear end wall having a predetermined left-to-right width, left and right side walls having a predetermined height, a front end wall having a predetermined height, and a full-length cover panel hingedly attached to said rear end wall and extending substantially all the way to said front end wall and having a predetermined front-to-rear length;

wherein (a) the predetermined front-to-rear length of said bottom panel is longer than the predetermined left-to-right width of said bottom panel and the predetermined front-to-rear length of said full-length cover panel is substantially shorter than the predetermined front-to-rear length of said bottom panel, and (b) at least one of the front and rear end walls is disposed at a substantially acute angle to said bottom panel and said left and right side walls are each disposed at a substantially non-acute angle to said bottom panel.

13. The pizza carton of claim 12 further comprising:

left and right cover side flaps hingedly attached to said full-length cover panel and having a predetermined height substantially equal to the predetermined height of said left and right side walls.

14. The pizza carton of claim 13 wherein:

said left and right cover side flaps are disposed exterior to said left and right side walls, respectively.

15. A non-fastened pizza carton containing a recently-cooked pizza having a predetermined maximum diameter, said carton being of foldable material and comprising:

a bottom panel having a predetermined front-to-rear length and a predetermined left-to-right width, a rear end wall attached to said bottom panel and having a predetermined left-to-right width, left and right side wall structures comprising respective left and right side walls attached to said bottom panel and having a predetermined height, a front wall structure comprising a front end wall attached to said bottom panel and having a predetermined height, and a cover comprising a full-length cover panel hingedly attached to said rear end wall and extending substantially all the way to said front end wall and having a predetermined front-to-rear length;

wherein (a) the predetermined front-to-rear length of said bottom panel is at least six millimeters longer than the predetermined maximum diameter of said pizza and the predetermined front-to-rear length of said full-length cover panel is at least eight millimeters shorter than the predetermined maximum diameter of said pizza, and (b) at least one of the front and rear end walls is disposed at a substantially acute angle to said bottom panel and said left and right side walls are each disposed at a substantially non-acute angle to said bottom panel.

16. The pizza carton of claim 15 wherein:

said left and right side wall structures further comprise respective left and right front corner panels hingedly attached to a front end of said left and right side walls and respective left and right connector panels hingedly attached to a bottom edge of said left and right front corner panels and overlying said bottom panel, said front wall structure further comprises left and right end panels hingedly attached to left and right ends of said front end wall and to said left and right connector panels, respectively, said front end wall having a top edge free of attachment, said cover further comprises (a) left and right cover side flap structures comprising (i) respective left and right cover side flaps hingedly attached to said cover panel and disposed exterior to said left and right side walls and (ii) respective left and right corner flaps hingedly attached to a rear end of said left and right cover side flaps and disposed approximately perpendicular to said left and right cover side flaps, and (b) a cover front flap hingedly attached to said cover panel and disposed between said left and right end panels and having a predetermined height.

17. The pizza carton of claim 16 wherein:

the predetermined height of said cover front flap is substantially less than the predetermined height of said front end wall.

18. First and second non-fastened inward-slanting-wall pizza cartons disposed in a stacked arrangement, each of the cartons being of foldable material and comprising:

a bottom panel, a plurality of walls including opposing first and second walls and opposing third and fourth walls, each of said first and second walls being disposed at a substantially acute angle to said bottom panel and each of said third and fourth walls being disposed at a substantially non-acute angle to said bottom panel, and a full-length cover panel hingedly attached to a wall of said plurality of walls and extending substantially all the way to an opposing wall;

wherein each of said first and second non-fastened inward-slanting-wall pizza cartons is free of any stacking-impeding tab projecting beyond a top surface of said cover panel, whereby the bottom panel of the first carton contacts at least two perimeter edges of the cover panel of the second carton.

19. The first and second pizza cartons of claim 18 wherein:

said any stacking-impeding tab is a tab projecting from one of said third and fourth walls.

20. A non-fastened food carton having a unique cover, said carton being of foldable material and comprising:

a bottom panel having a predetermined left-to-right width and a predetermined front-to-rear length, a rear end wall having a predetermined left-to-right width at least as long as the predetermined left-to-right width of said bottom panel, left and right side wall structures comprising respective left and right side walls disposed approximately perpendicular to said rear end wall, respective left and right front corner panels hingedly attached to a front end of said left and right side walls, and respective left and right connector panels hingedly attached to a bottom edge of said left and right front corner panels and overlying said bottom panel, a front wall structure comprising a front end wall having a predetermined height and left and right end panels hingedly attached to respective left and right ends of said front end wall and to said left and right connector panels, said front end wall having a top edge free of attachment, and a cover comprising (a) a cover panel hingedly attached to said rear end wall and having a predetermined left-to-right width and a predetermined front-to-rear length, (b) left and right cover side flap structures comprising respective left and right cover side flaps having a front end free of attachment and hingedly attached to said cover panel at respective left and right cover side flap fold lines disposed approximately perpendicular to said rear end wall, and (c) a cover front flap hingedly attached to said cover panel and disposed between said left and right end panels and having a predetermined height substantially less than the predetermined height of said front end wall.

21. The carton of claim 20 wherein:

the predetermined left-to-right width of said rear end wall is at least six millimeters longer than the predetermined left-to-right width of said cover panel.

22. The carton of claim 20 wherein:

said front end wall and said rear end wall are each disposed at a substantially acute angle to said bottom panel and said left and right side walls are each disposed at a substantially non-acute angle to said bottom panel.

23. The carton of claim 20 wherein:

said left and right cover side flap structures further comprise respective left and right corner flaps hingedly attached to a rear end of said left and right cover side flaps at left and right corner flap fold lines disposed at an obtuse angle to said left and right cover side flap fold lines, respectively.

24. The carton of claim 20 wherein:

the predetermined front-to-rear length of said bottom panel is longer than the predetermined left-to-right width of said bottom panel and the predetermined front-to-rear length of said cover panel is substantially shorter than the predetermined front-to-rear length of said bottom panel.

25. A non-fastened food carton having exterior cover side flaps and a rigidizing rear wall structure, said carton being of foldable material and comprising:

a bottom panel having a predetermined left-to-right width, a rear end wall having a predetermined left-to-right width, left and right side wall structures comprising respective left and right side walls, and a cover comprising (a) a cover panel hingedly attached to said rear end wall and having a predetermined left-to-right width and (b) left and right cover side flap structures comprising (i) respective left and right cover side flaps hingedly attached to said cover panel at respective left and right cover side flap fold lines and disposed exterior to said left and right side walls, and (ii) respective left and right corner flaps hingedly attached to a rear end of said left and right cover side flaps at respective left and right corner flap fold lines and disposed between said rear end wall and a rear end of said left and right side walls, respectively;

wherein the predetermined left-to-right width of said rear end Wall is at least six millimeters longer than the predetermined left-to-right width of said cover panel, whereby the rear ends of said left and right cover side flaps are prevented from sliding beyond left and right ends of said rear end wall when the cover of said carton is pushed in a rearward direction relative to the bottom panel.

26. The carton of claim 25 wherein:

said left and right corner flap fold lines are disposed at an obtuse angle to said left and right cover side flap fold lines, respectively.

27. A blank for a non-fastened food carton, said blank being of foldable material cut and scored to define:

a bottom panel having a predetermined front-to-rear length and a predetermined left-to-right width, a rear end wall attached to said bottom panel and having a predetermined left-to-right width, left and right side wall structures comprising respective left and right side walls attached to said bottom panel, a front wall structure comprising a front end wall attached to said bottom panel and having a predetermined height, and a cover comprising (a) a cover panel attached to said rear end wall and having a predetermined front-to-rear length and a predetermined left-to-right width and (b) left and right cover side flap structures comprising (i) respective left and right cover side flaps hingedly attached to said cover panel at respective left and right cover side flap fold lines and (ii) respective left and right corner flaps attached to a rear end of said left and right cover side flaps at respective left and right corner flap fold lines;

wherein said left and right corner flap fold lines are disposed at an obtuse angle to said left and right cover side flap fold lines, respectively.

28. The blank of claim 27 wherein:

the predetermined left-to-right width of said rear end wall is at least six millimeters longer than the predetermined left-to-right width of said cover panel.

29. The blank of claim 27 wherein:

said cover further comprises a cover front flap attached to a front edge of said cover panel and having a predetermined height substantially less than the predetermined height of said front end wall.

30. The blank of claim 27 wherein:

the predetermined front-to-rear length of said bottom panel is longer than the predetermined left-to-right width of said bottom panel and the predetermined front-to-rear length of said cover panel is substantially shorter than the predetermined front-to-rear length of said bottom panel.

31. The blank of claim 27 wherein:

said left and right corner flaps have a lower edge disposed in non-alignment to a lower edge of said left and right cover side flaps, respectively.

32. The blank of claim 27 wherein:

said left and right side wall structures further comprise respective left and right front corner panels attached to a front end of said left and right side walls and respective left and right connector panels attached to a bottom edge of said left and right corner panels, said front wall structure further comprises left and right end panels respectively attached to left and right ends of said front end wall and to said left and right connector panels, said cover further comprises a cover front flap attached to a front edge of said cover panel and having a predetermined height substantially less than the predetermined height of said front end wall, and the predetermined front-to-rear length of said cover panel is substantially less than the predetermined front-to-rear length of said bottom panel.

33. The blank of claim 32 wherein:

each of said left and right front corner panels has a front end disposed at an acute angle to said bottom edge.

* * * * *